US006845891B2

(12) United States Patent
Hirata

(10) Patent No.: US 6,845,891 B2
(45) Date of Patent: Jan. 25, 2005

(54) BUTTON FASTENING DEVICE

(76) Inventor: Sumie Hirata, 445-11 Kojimayanaida-cho, Kurashiki-shi, Okayama-ken (JP)

( * ) Notice: Subject to any disclaimer, the term of this patent is extended or adjusted under 35 U.S.C. 154(b) by 0 days.

(21) Appl. No.: 10/319,518

(22) Filed: Dec. 16, 2002

(65) Prior Publication Data

US 2003/0116594 A1 Jun. 26, 2003

(30) Foreign Application Priority Data

Dec. 20, 2001 (JP) ..... 2001-388257

(51) Int. Cl.[7] ..... A47G 25/90
(52) U.S. Cl. ..... 223/111; 24/40
(58) Field of Search ..... 223/111; 24/40

(56) References Cited

U.S. PATENT DOCUMENTS 319,015 A * 6/1885 Paine ..... 24/41.1
413,314 A 10/1889 Betzel
894,190 A * 7/1908 Crane ..... 24/40
1,463,400 A * 7/1923 Neumann ..... 24/40
1,879,903 A 9/1932 Kleiber
2,663,588 A * 12/1953 Scheldorfer ..... 294/3.6
4,942,646 A 7/1990 Sebastian
5,347,688 A * 9/1994 Ross ..... 24/40
6,446,312 B1 * 9/2002 Kabat ..... 24/40

FOREIGN PATENT DOCUMENTS

JP 2001161539 6/2001

* cited by examiner

*Primary Examiner*—John J. Calvert
*Assistant Examiner*—James G Smith
(74) *Attorney, Agent, or Firm*—Clark & Brody

(57) ABSTRACT

A button fastening device includes a button holding section formed with a button guide opening and a gripper section. The button guide opening 6 is formed so as to extend in one direction and the gripper section is formed so as to extend in a direction obliquely intersecting the above-mentioned one direction.

5 Claims, 5 Drawing Sheets

1
6
7
8
8a
8b
8c
9
11
11B
12
15
3
7a
7b
7c
7d
7e
A
B
L
L
C
C
II
II
4
4a
4b
21
21
W
q
R1
R2

BUTTON FASTENING DEVICE

BACKGROUND OF THE INVENTION

This invention relates to a button fastening device for fastening buttons put on clothes such as pants into the corresponding button holes.

Japanese Patent Application No. 2001-161539A discloses a button fastening device intended for facilitating the buttons put on clothes such as denim pants to be fastened into the corresponding button holes. At the site for manufacturing pants and/or jackets using stiff cloth such as denim and/or jean, it is essential to prepare such a button fastening device.

SUMMARY OF THE INVENTION

The button fastening device of prior art disclosed in the above-cited Publication has a rectilinear shape in the longitudinal direction, an principal object of this invention is to overcome the inconvenience experienced by such a known button device.

According to this invention, there is provided a button fastening device comprising a front half formed with a button holding section having a button guide opening rectilinearly extending in one direction and a rear half formed with a gripper section. The guide opening includes a first guide opening lying adjacent the gripper section and having a relatively large width in a direction orthogonal to the one direction and a second guide opening being contiguous to and in front of the first guide opening and having a width smaller than the width of the first guide opening.

The gripper section extends in rearward direction from the button holding section obliquely with respect to the one direction.

This invention includes the following embodiments.

The gripper section curves rearward.

The gripper section has a width gradually enlarged as more remote from the button holding section the gripper section is.

At least one additional guide opening having a width smaller than the width of the first guide opening and larger than the width of the second guide opening is interposed between and contiguous to the first guide opening and the second guide opening.

DETAILED DESCRIPTION OF THE PREFERRED EMBODIMENTS

Details of a button fastening device according to this invention will be more fully understood from the description given hereunder with reference to the accompanying drawings.

Figure 1:
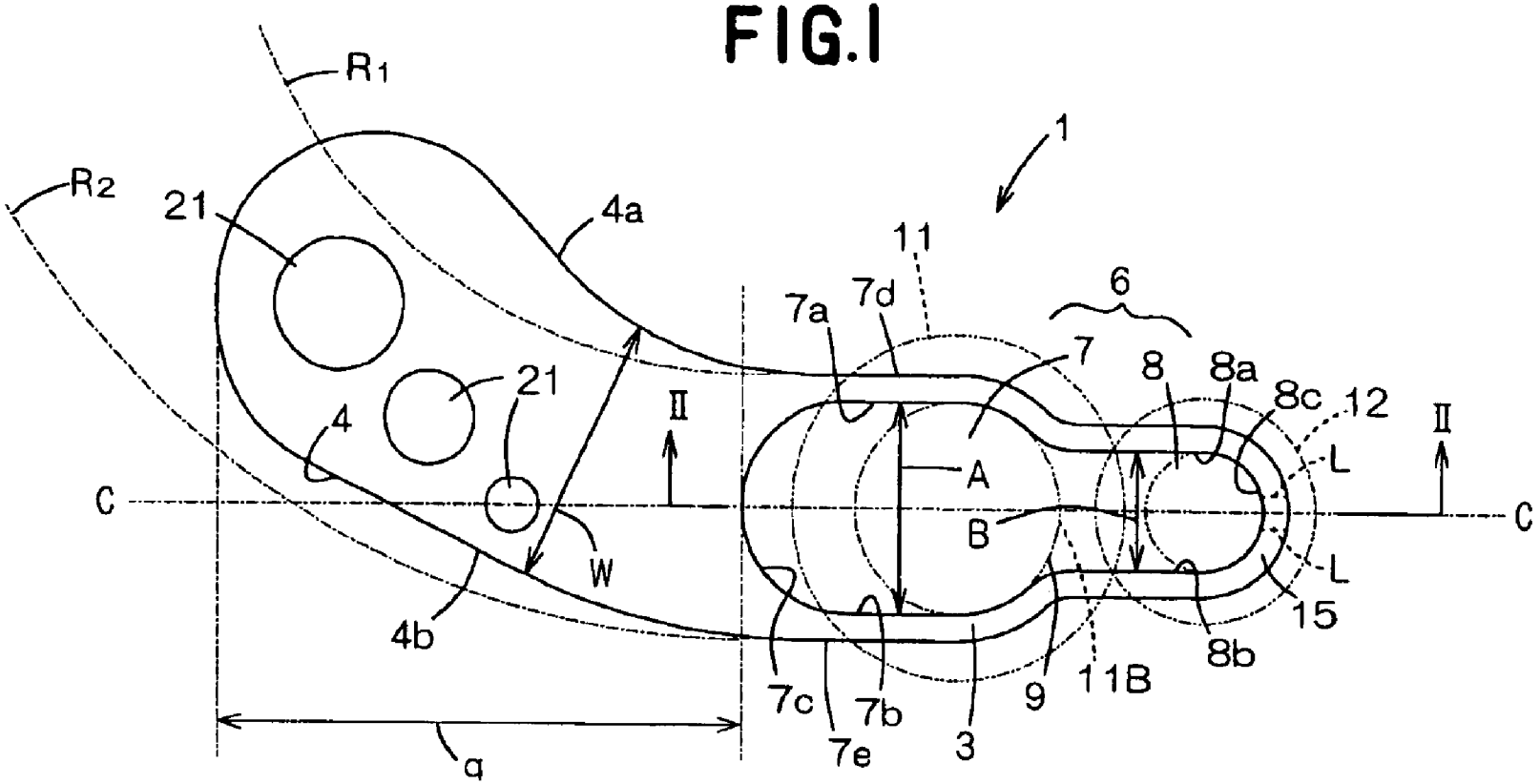
FIG. 1 is a plan view of a button fastening device according to this invention.
Figure 2:
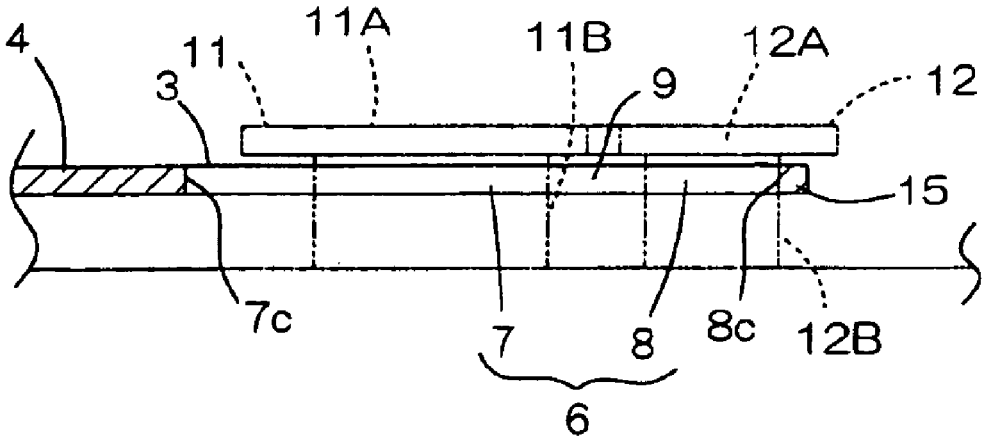
FIG. 2 is a cross-sectional view taken along a line II—II in FIG. 1.

FIG. 1 is a plan view of a button fastening device 1 according to this invention and FIG. 2 is a cross-sectional view taken along a line II—II in FIG. 1. The button fastening device 1 is made of, for example, metal or plastics and includes a button holding section 3 defined by its front half and a gripper section 4 defined by its rear half. The button holding section 3 is formed with a guide opening 6 extending along a horizontal line C—C in a transverse direction as viewed in FIG. 1. The guide opening 6 comprises a first guide opening 7 lying adjacent the gripper section 4 and having a relatively large width A as measured in a direction orthogonal to the horizontal line C—C and a second guide opening 8 being contiguous to the first guide opening 7 so as to lie adjacent the button holding section 3 and having a width B smaller than the width A of the first guide opening 7. The horizontal line C—C is defined by a center line bisecting the widths A, B of the respective guide openings 7, 8 which respectively have rectilinear inner edges 7*a*, 7*b*, 8*a*, 8*b* extending in parallel to the horizontal line C—C and circular arc-shaped inner edges 7*c*, 8*c* extending between the rectilinear inner edges 7*a* and 7*b* and between the rectilinear inner edges 8*a* and 8*b*, respectively. The guide opening 6 is configured so that, in an intermediate zone 9 between the first guide opening 7 and the second guide opening 8, the guide opening 6 has its width being gradually narrowed toward the second guide opening 8. The circular arc-shaped inner edge 8*c* of the second guide opening 8 defines a front end 15 of the button fastening device 1 and the front end 15 is closed along the circular arc-shaped inner edge 8*c* as illustrated. It should be understood that the circular arc defining this front end 15 may be partially cut away between a pair of chain lines L, L to partially open the circular arc, if it is desired. In FIGS. 1 and 2, a first button 11 (See FIG. 4) engaged within the first guide opening 7 and a second button 12 (See FIG. 4) engaged within the second guide opening 8 are indicated by imaginary lines.

The gripper section 4 defined by the rear half of the button fastening device 1 extends rearward in a direction obliquely intersecting the horizontal line C—C preferably in such a manner that the gripper section 4 curves downward as viewed in FIG. 1. Further preferably, the gripper section 4 is dimensioned so that its width W is gradually enlarged from the button holding section 3 toward the rear end of the button fastening device 1. The gripper section 4 may be formed with appropriate number of through-holes 21 used for insertion of cords and/or weight saving of the button fastening device 1. In the case of the portable button fastening device, the gripper section 4 preferably has its width W in a range of 20–40 mm or less and its length q on the horizontal line C—C as measured from the rear end of the first guide opening 7 to the rear end of the gripper section 4 is preferably in a range of 30–80 mm. In the state as illustrated in FIG. 1, the gripper section 4 has an upper edge 4*a* and a lower edge 4*b* both of which lie on extensions of the rectilinear outer edges 7*d*, 7*e* extending in parallel to the rectilinear inner edges 7*a*, 7*b* of the first guide opening 7, respectively. Preferably, the curved upper edge 4*a* lies above the imaginary line defined by a curvature radius $R_1$=120 mm and the curved lower edge 4*b* lies above the imaginary line defined by a curvature radius $R_2$=200 mm.

Figure 3:
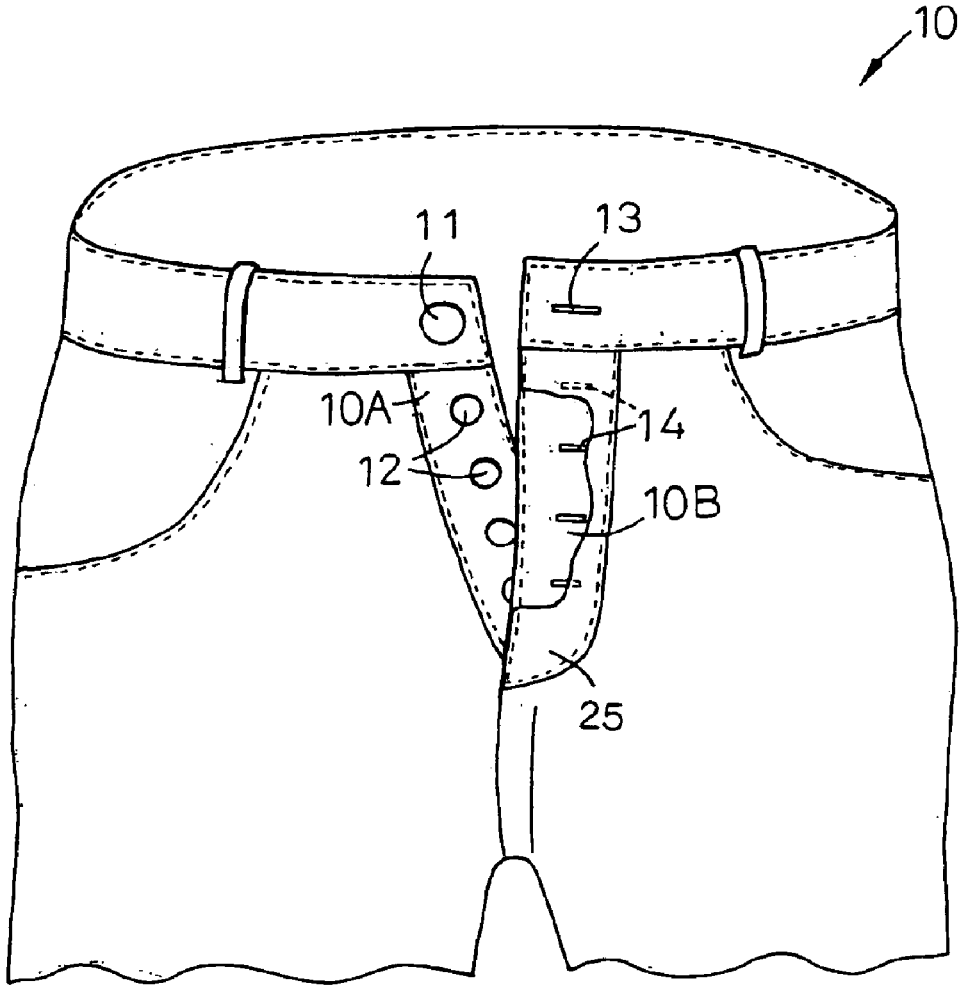
FIG. 3 is a fragmentary perspective view of pants.

FIG. 3 is a partially cutaway perspective view of pants 10 which the button fastening device 1 is intended for. With the pants 10, one relatively large first button 11 and a plurality of relatively smaller second buttons 12 are put on an inner fly 10A and a relatively large first button hole 13 and an outer fly 10B is formed with a plurality of relatively small second button holes 14 so as to be associated with the corresponding buttons 11, 12. In the case of the pants 10 made of thick and stiff cloth such as denim or jean, it is often troublesome to fasten the first and second buttons 11, 12 into the first and second button holes 13, 14.

Figure 4:
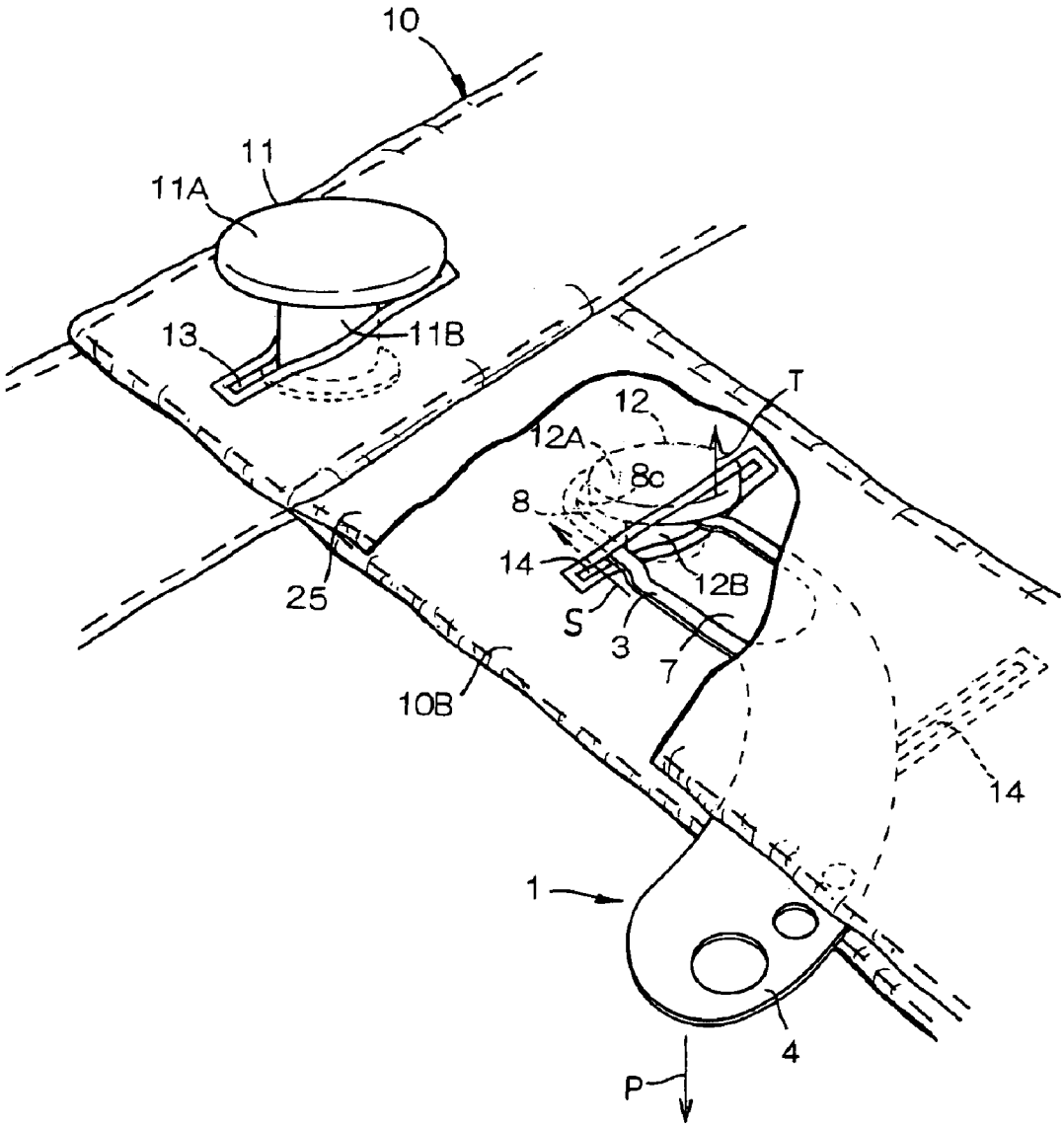
FIG. 4 is a perspective view showing the button fastening device during its use.

FIG. 4 illustrates the button fastening device 1 during its use together with a part of the pants 10 put on wearer's body, in which the pants 10 are illustrated with the button cover 25 partially cutaway. Referring to FIG. 4, the first button 11 has already been fastened into the first button hole 13 using the button fastening device 1 and a head 11A of the first button 11 is covering out of the first button hole 13. Each of the second buttons 12 can be fastened into the corresponding the second button holes 14 covered with the button cover 25 in a manner as follows. First, with the gripper section 4 of the button fastening device 1 held by one hand, the button holding section 3 is guided in a direction indicated by an arrow S, i.e., from a lower level toward an upper level of the pants 10 until the button holding section 3 passes through between the outer fly 10B and the button cover 25 into the corresponding second button hole 14. Then, a head 12A of the second button 12 is inserted into one of the first and second guide opening 7, 8 and a shank 12B of the second button 12 is placed against the circular arc-shaped inner edge 8*c* of the second guide opening 8. Thereafter, the button fastening device 1 is turned so that the head 12A of this second button 12 may be moved in a direction indicated by an arrow T, i.e., away from the wearer's body while the gripper section 4 may be moved in a direction indicated by an arrow P opposite to the direction of the arrow T, i.e., toward the wearer's body until the head 12A is pulled out from the outer fly 10B. In this way, the second buttons 12 can be easily fastened into the corresponding second button holes 14. The first button 11 can be fastened into the first button hole 13 in the similar manner in which the second buttons 12 are fastened into the second button holes 14. If a shank 11B of the first button 11 has a diameter larger than the width B of the second guide opening 8, the shank 11B may be placed against the inner edge of the button holding section 3 in the intermediate zone 9 and the button fastening device 1 may be turned in the same manner as the case illustrated in FIG. 4.

In the course of inserting the button fastening device 1 upward into the first button hole 13 or the any one of the second button holes 14, the gripper section 4 obliquely extending from the button holding section 3 remains exposed outside the, edge of the outer fly 10B. Such feature advantageously facilitates the button fastening device 1 to be held and operated in comparison with the known button fastening device in which the button holding section and the gripper section rectilinearly extend and the gripper section tends to be covered with the button cover 25. Particularly with the illustrated arrangement such that the second button holes 14 are covered with the button cover 25, the button fastening device 1 according to this invention drastically facilitates the buttons to be fastened into the corresponding button holes. This is for the reason that the gripper section 4 remains exposed outside the edge of the button cover 25 as the button holding section 3 is inserted into each of the second button holes 14. The embodiment of the gripper section 4 which is curved and preferably has its width W gradually enlarged toward the rear end of the gripper section 4 further facilitates the button fastening device 1 to be held and allows the operation of button fastening to be rapidly done. The button fastening device 1 according to this invention allows the buttons of two sizes to be fastened into the associated button holes using one and same button fastening device. With a consequence, it is no more necessary at the site of manufacturing the pants 10 to select the fastening device adapted for the respective sizes of the buttons.

Figure 5:
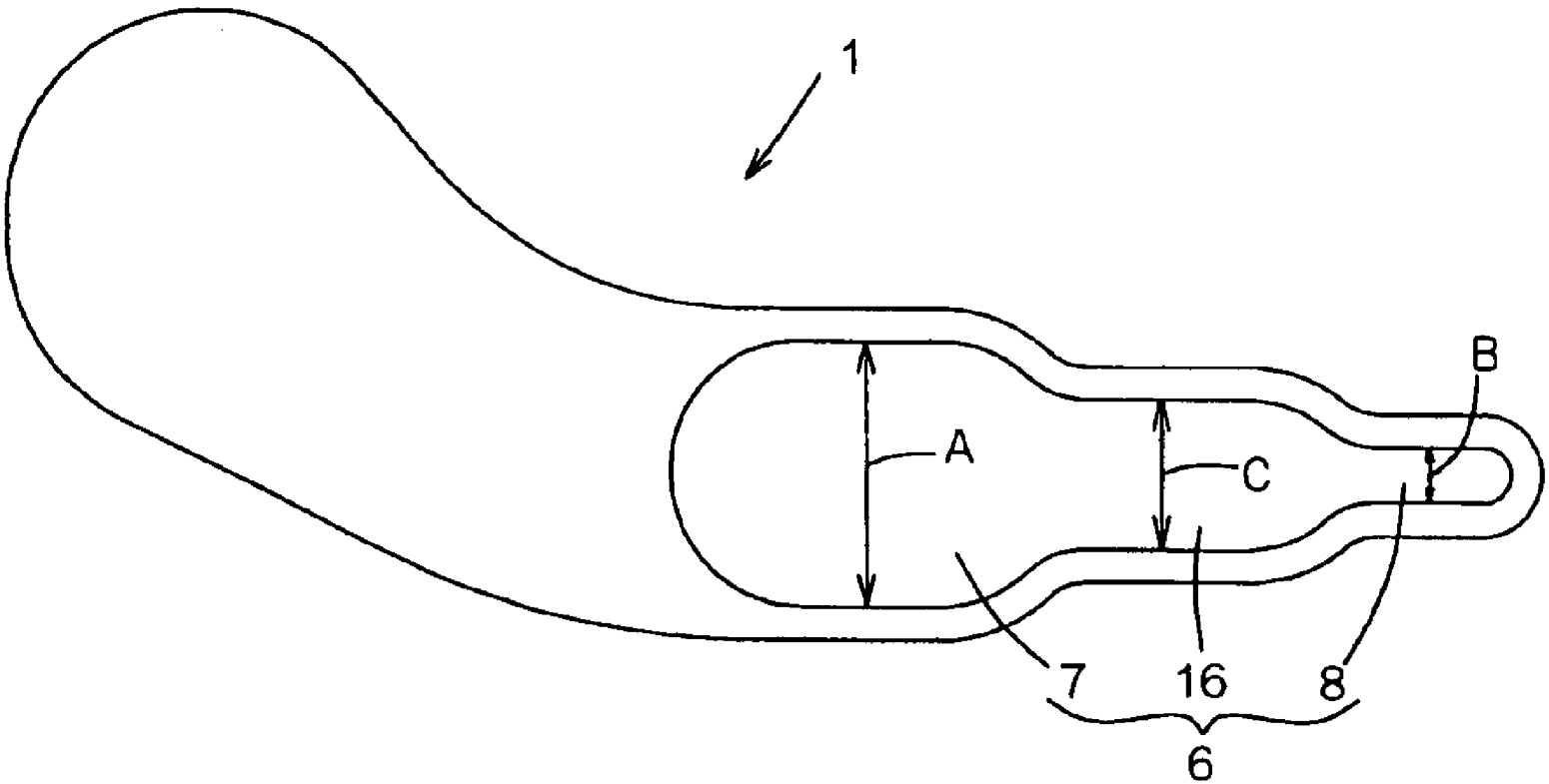
FIG. 5 is a view similar to FIG. 1, showing one preferred embodiment of the button fastening device according to this invention.

FIG. 5 is a view similar to FIG. 1, showing one preferred embodiment of the button fastening device according to this invention. In this embodiment of the button fastening device 1, the guide opening 6 comprises, in addition to the first guide opening 7 and the second guide opening 8, a third guide opening 16 extending between these first and second guide openings 7, 8. The third guide opening 16 is contiguous to the first guide opening 7 as well as to the second guide opening 8 and has a width D smaller than the width A of the first guide opening 7 and larger than the width B of the second guide opening 8. This embodiment of the button fastening device 1 allows one and same button fastening device 1 to be used for the buttons having a more wide range of sizes than in the embodiment illustrated by FIG. 1. Not only the third guide opening 16, further additional guide opening or openings may be formed between the first and second guide openings 7, 8.

The button fastening device according to this invention includes the gripper section which extends in the direction obliquely intersecting the direction in which the button holding section extends. Such feature facilitates the buttons to be fastened into the corresponding button holes even when the button holes of the pants worn by the wearer are covered with the button cover. The curved gripper section having its width gradually enlarged toward the rear end of the gripper section facilitates the button fastening device to be easily held and allows the button fastening operation to be rapidly done.

What is claimed is:

1. A button fastening device comprising:

a front half formed with a button holding section having a button guide opening rectilinearly extending in one direction; and a rear half formed with a gripper section;

said guide opening including a first guide opening lying adjacent said gripper section and having a relatively large width in a direction orthogonal to said one direction and a second guide opening being contiguous to and in front of said first guide opening and having a width smaller than said width of said first guide opening; and said gripper section extending in a rearward direction from said button holding section obliquely with respect to said one direction;

wherein the front half and rear half are generally in the same plane.

2. The button fastening device according to claim 1, wherein said gripper section curves rearward.

3. The button fastening device according to claim 1, wherein said gripper section has a width gradually enlarged as more remote from said button holding section said gripper section is.

4. The button fastening device according to claim 1, wherein at least one additional guide opening having a width smaller than said width of said first guide opening and larger than said width of said second guide opening is interposed between and contiguous to said first guide opening and said second guide opening.

5. The button fastening device according to claim 1, wherein said gripper section is shaped in a plane.

* * * * *